United States Patent [19]

Wiewiorowski et al.

[11] 4,105,741

[45] Aug. 8, 1978

[54] PROCESS FOR RECOVERY OF URANIUM FROM WET PROCESS PHOSPHORIC ACID

[75] Inventors: Tadeusz Karol Wiewiorowski, New Orleans; Willis Lee Thornsberry, Jr., Gretna, both of La.

[73] Assignee: Freeport Minerals Company, New York, N.Y.

[21] Appl. No.: 664,996

[22] Filed: Mar. 8, 1976

[51] Int. Cl.[2] ..... B01D 11/04

[52] U.S. Cl. ..... 423/10; 423/139

[58] Field of Search ..... 423/10, 139

[56] References Cited

U.S. PATENT DOCUMENTS

| | | | |
|---|---|---|---|
| 2,790,702 | 4/1957 | McCullough | 423/10 |
| 2,859,092 | 11/1958 | Bailes et al. | 423/10 |
| 2,885,260 | 5/1959 | Maraman et al. | 423/10 |
| 3,193,381 | 7/1965 | George | 75/108 |
| 3,214,239 | 10/1965 | Hazen et al. | 423/10 |

*Primary Examiner*—Richard E. Schafer

*Attorney, Agent, or Firm*—Fisher, Christen & Sabol

[57] ABSTRACT

Process for the recovery of uranium from wet process phosphoric acid solution in which an organic extractant, containing uranium values and dissolved iron impurities and comprising a dialkylphosphoric acid and a trialkylphosphine oxide dissolved in a water immiscible organic solvent, is contacted with a substantially iron-free dilute aqueous phosphoric acid to remove said iron impurities. The removed impurities are bled from the system by feeding the resulting iron-loaded phosphoric acid to a secondary countercurrent uranium extraction operation from which they leave as part of the uranium-depleted acid raffinate. Also, process for recovering uranium in which the extractant, after it has been stripped of uranium values by aqueous ammonium carbonate, is contacted with a dilute aqueous acid selected from the group consisting of $H_2SO_4$, HCl, $HNO_3$ and iron-free $H_3PO_4$ to improve the extraction efficiency of the organic extractant.

11 Claims, 1 Drawing Figure

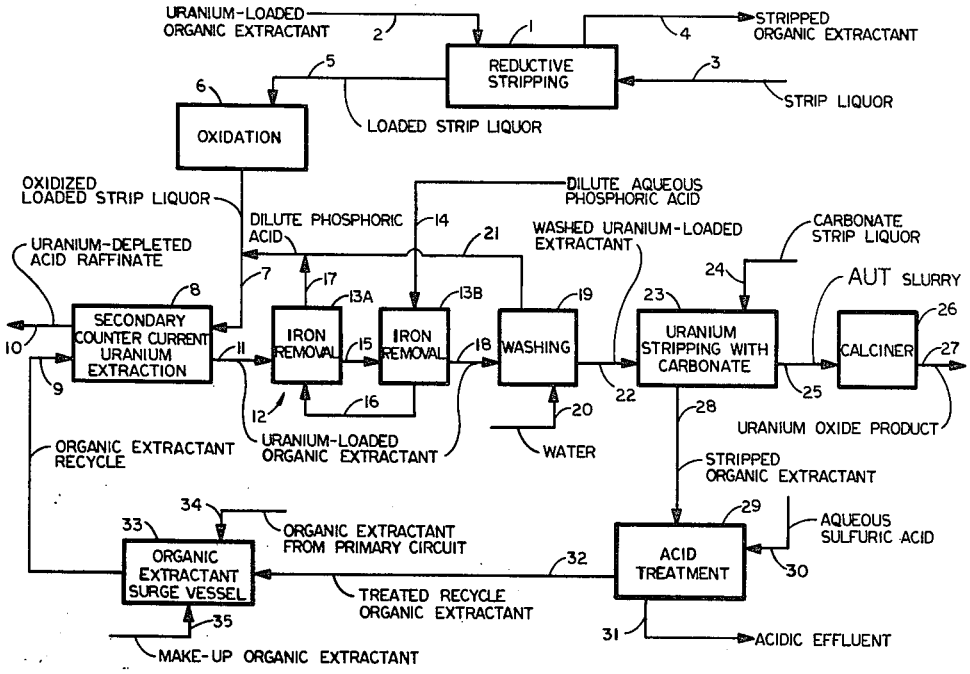

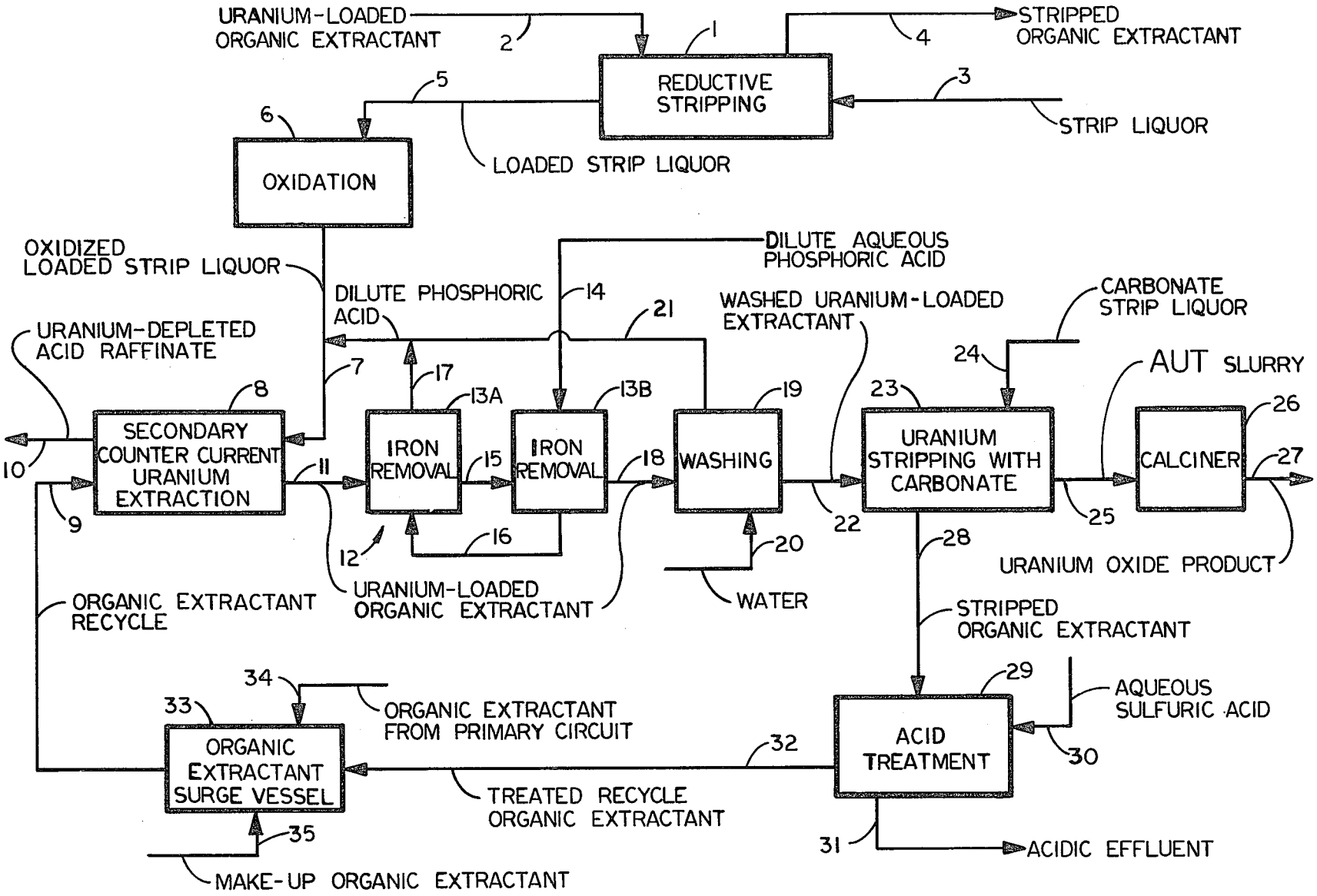
STRIPPED ORGANIC EXTRACTANT
STRIP LIQUOR
REDUCTIVE STRIPPING
LOADED STRIP LIQUOR
URANIUM-LOADED ORGANIC EXTRACTANT
OXIDATION
DILUTE PHOSPHORIC ACID
OXIDIZED LOADED STRIP LIQUOR
URANIUM-DEPLETED ACID RAFFINATE
SECONDARY COUNTER CURRENT URANIUM EXTRACTION
ORGANIC EXTRACTANT RECYCLE
IRON REMOVAL
IRON REMOVAL
URANIUM-LOADED ORGANIC EXTRACTANT
DILUTE AQUEOUS PHOSPHORIC ACID
WASHED URANIUM-LOADED EXTRACTANT
WASHING
WATER
CARBONATE STRIP LIQUOR
URANIUM STRIPPING WITH CARBONATE
AUT SLURRY
CALCINER
URANIUM OXIDE PRODUCT
STRIPPED ORGANIC EXTRACTANT
AQUEOUS SULFURIC ACID
ACID TREATMENT
ACIDIC EFFLUENT
TREATED RECYCLE ORGANIC EXTRACTANT
ORGANIC EXTRACTANT FROM PRIMARY CIRCUIT
ORGANIC EXTRACTANT SURGE VESSEL
MAKE-UP ORGANIC EXTRACTANT

PROCESS FOR RECOVERY OF URANIUM FROM WET PROCESS PHOSPHORIC ACID

BACKGROUND OF THE INVENTION

1. Field of the Invention

This invention relates to an improved process for the recovery of uranium values from organic extractants used in solvent extraction processes.

2. Description of the Prior Art

Phosphate rock can contain from 50 to 400 parts per million (p.p.m.) by weight of uranium (expressed as $U_3O_8$), depending on its type and origin. A major portion of this uranium becomes solubilized during the acidulation of phosphate rock and ends up as a component of the phosphoric acid. It is estimated that, at the present time, over 4 million pounds of uranium per year are so processed in the United States without being recovered. Organic extractants capable of removing the uranium from the phosphoric acid are presently available. The recovery of uranium values from such organic extractants is an essential step in any overall system for uranium recovery from phosphoric acid by solvent extraction.

The presence of uranium in phosphate rock and in phosphoric acid has been recognized for many years. Consequently, a process as described in "Uranium Recovery from Wet Process Phosphoric Acid" by B. F. Greek, O. W. Allen, and Donald E. Tynan, Industrial and Engineering Chemistry, vol. 49, No. 4, page 608 (1957), was developed and utilized for the recovery of uranium from phosphoric acid produced by treatment of Florida phosphate rock with sulfuric acid. The commercial application of this process was short-lived, however, due primarily to the technical and economic disadvantages which made uranium recovery by this process unattractive as compared to direct uranium production from uranium ores. The major disadvantages of this process included the chemically unstable nature of the extracting reagent, the poor phase separation in the solvent extraction circuit and the expensive pretreatment of the phosphoric acid requiring the use of elemental iron.

Recognizing the disadvantages of the prior art, a research team at the Oak Ridge National Laboratory developed a new solvent extraction system which does not suffer from the shortcomings referred to above. In this system, as reported in "Solvent Extraction of Uranium From Wet-Process Phosphoric Acid", by F. J. Hurst, D. J. Crouse, and K. B. Brown, Oak Ridge National Laboratory, Technical Manuscript 2522, April 1969, the uranium was extracted from phosphoric acid with an organic solution containing a dialkylphosphoric acid and a trialkylphosphine oxide. The uranium-containing organic solution was then subjected to a washing step to remove phosphoric acid and to a stripping step, utilizing an aqueous ammonium hydroxide-ammonium carbonate stripping solution, to concentrate and recover the uranium values. In the stripping operation, the uranium values were transferred from the organic to the aqueous phase. Since the organic solution contained a dialkylphosphoric acid, ammonia values were absorbed into the organic phase from the stripping solution to form the corresponding ammonium salt of this acid. After the stripping operation, the ammonia-carrying organic solvent was returned to the uranium extraction circuit for contact with fresh phosphoric acid. The absorption of the ammonia values by the phosphoric acid resulted in ammonia losses and in undesirable contamination of the phosphoric acid. This new system had certain other distinct disadvantages, namely high ammonia consumption costs resulting from the selection of an aqueous ammonium hydroxide-ammonium carbonate stripping solution, and phosphoric acid losses encountered in the washing step of the solvent extraction circuit.

Most of these drawbacks were corrected by the process described in U.S. Pat. No. 3,737,513, the disclosure of which is included herein by reference. This patent describes the discovery that uranium values can be obtained from an organic extractant containing a dialkylphosphoric acid and a trialkylphosphine oxide by using an acidic aqueous liquor, containing:

(1) a dissolved divalent iron salt, and (2) a complexing agent selected from the group consisting of phosphoric acid, hydrofluoric acid and mixtures thereof.

The processes heretofore described were also subject to the further drawback that relatively high amounts of iron are carried over with the uranium product. The relatively high amount of iron reports as an impurity in the final $U_3O_8$ product unless it is removed. Another drawback in the prior processes was the formation of a precipitate of some kind of phosphatic compounds upon extraction with organic extractant recycled directly from the ammonium carbonate stripping stage. This causes disruption of the extraction operation with losses in overall efficiency of operation, extractant losses and loss of valuable $P_2O_5$. The precipitate formed has to be removed to prevent phase separation problems and scaling and clogging of extraction equipment. Also, extractant losses result by entrainment of the valuable extractant around the precipitated solids. No prior art is known which purports to solve these problems.

SUMMARY OF THE INVENTION

The present invention provides a process for recovering uranium including the removal of iron from an extractant containing the uranium and iron and comprising a dialkylphosphoric acid and a trialkylphosphine oxide dissolved in a water immiscible organic solvent. The process involves the contacting of the above-identified extractant with substantially iron-free, dilute, aqueous phosphoric acid to remove the iron in the extractant and ultimately provide a uranium product that is iron-free or very low in iron content.

The invention also provides a process for recovering uranium including the treatment of the extractant comprising dialkylphosphoric acid and trialkylphosphine oxide dissolved in a water-immiscible organic solvent after it has extracted uranium values from a strip liquor containing phosphoric acid and said uranium values and after it has been subsequently stripped of said uranium values by aqueous ammonium carbonate. The treatment of this invention is applied to the extractant before it is recycled to contact additional strip liquor containing phosphoric acid and said uranium values and comprises contacting the stripped extractant with a dilute aqueous acid selected from the group consisting of sulfuric acid, hydrochloric acid, nitric acid and iron-free phosphoric acid to avoid the formation of undesirable phosphatic precipitates during subsequent extraction of uranium values by the recycled extractant.

Essentially, the basic process to which the improvements of this invention can be applied involves the extraction of wet process phosphoric acid (acid made by the $H_2SO_4$ acidulation of phosphate rock) with an organic solvent extractant (preferably TOPO-D2EHPA, i.e., trioctylphosphine oxide and di-2-ethylhexylphosphoric acid dissolved in a suitable kerosene-type diluent), followed by the "reductive stripping" of the uranium-loaded extractant with a strip liquor comprising a dilute phosphoric acid containing ferrous iron in it. The uranium-loaded strip solution (now reduced in size to a fraction of the volumetric flow of the loaded organic feed solution) is oxidized and then re-extracted with the organic solvent extractant and the new extract is washed and re-stripped, this time with an ammoniacal carbonate solution. The product of this second stripping operation is a uranium-bearing steam comprising a slurry and/or an aqueous solution of ammonium uranyl tricarbonate, or "AUT", from which the uranium values are subsequently recovered. The final step of the process is usually a calcining operation where $U_3O_8$ is made as the end product. The first extraction-stripping operations are referred to as the primary circuit of the process; the second extraction-stripping operations are referred to as the secondary circuit. The basic steps of this process are disclosed in U.S. Pat. Nos. 3,711,591 and 3,737,513, the teachings of which are incorporated herein by reference.

The present invention relates to the secondary circuit and includes the incorporation of an iron-removal step after the secondary countercurrent uranium extraction. The problem solved by this invention is that the uranium-bearing stripping stream, which is a slurry and/or aqueous solution of AUT, previously contained too much iron and this iron reported as an impurity in the final calcined $U_3O_8$ product. This problem is eliminated according to this invention by the use of an iron-removal step which in one embodiment consists of two mixer-settler combinations where the uranium-loaded organic, having about 10,000 ppm $U_3O_8$ and about 400 mg/l Fe, is contacted with a very small flow of a 30% $P_2O_5$ phosphoric acid which is free of iron. It has been found that it is possible to eliminate the iron contamination of the calcined $U_3O_8$ by contacting the loaded organic extractant with as little as 1/500 (volumetric flow ratio) of an iron-free phosphoric acid in two stages before the loaded organic extractant is washed with water and then stripped with ammonium carbonate. By an iron-free acid is meant an acid having less than 0.3% Fe, that is, the iron content must be substantially nil. Preferably, less than 0.1% Fe, and more preferably less than 0.05% Fe, should be used. Furnace grade phosphoric acid will normally be acceptable for this purpose while wet process merchant grade phosphoric acid normally will not.

Another problem solved by the present invention is the loss of extraction efficiency of the organic extractant which is recycled to re-extract uranium after the carbonate stripping step and the formation of undesirable phosphatic compounds during extraction. It has been found that, if the organic extractant is recycled to the primary and/or secondary extraction steps directly from the uranium carbonate stripping step, a precipitate of some kind of phosphatic compounds forms upon extraction. This not only causes disruption of the extraction operation with losses in the overall efficiency of the operation as well as organic extractant losses but also results in the loss of valuable $P_2O_5$ from the phosphoric acid being used. Lower efficiencies of the extraction operations are encountered because the precipitate formed has to be removed to prevent phase separation problems and scaling and clogging of the extraction equipment. Also, organic extractant losses result from the entrainment of valuable organic extraction around the precipitated solids, and $P_2O_5$ losses result, of course, from the formation of the phosphatic compounds which consumes valuable phosphorus.

This problem is solved by subjecting the organic extractant after it is stripped in the carbonate stripping step to treatment with a dilute aqueous acid selected from the group consisting of $H_2SO_4$, HCl, $HNO_3$ and iron-free $H_3PO_4$. By an iron-free $H_3PO_4$ is meant a phosphoric acid having less than 0.3% Fe, that is, the iron content must be substantially nil. Preferably, less than 0.1% Fe, and more preferably less than 0.05% Fe, should be used. In a preferred embodiment, a 20% aqueous $H_2SO_4$ is used in a single stage mixer-settler combination to treat the stripped organic extractant. The extraction efficiency of the organic extractant has not been found to be adversely affected by the aqueous acid treatment: on the contrary, the treated recycled organic extractant shows improved qualities as a uranium extractant in the sense that the extraction can be carried out without any of the problems mentioned above.

The overall improved secondary circuit of the present invention therefore includes the steps of a countercurrent uranium extraction of an oxidized uranium-loaded phosphoric acid aqueous solution, followed by an iron-removal operation, followed by a washing operation to remove entrained and/or dissolved $H_3PO_4$, followed by the ammonium carbonate stripping operation and then a dilute acid treatment stage to avoid the formation of undesirable phosphatic precipitates during the subsequent extraction of uranium by the recycled organic extractant.

BRIEF DESCRIPTION OF THE DRAWING

The single FIGURE is a schematic diagram illustrating the processes of the present invention.

DESCRIPTION OF THE SPECIFIC EMBODIMENT

Referring to the FIGURE, the reductive stripping operation 1 is fed with the uranium-loaded organic extractant by stream 2 and with aqueous strip liquor by stream 3. The loaded organic extractant is obtained by countercurrent extraction of wet process acid using the organic extractant as described above. The stripped organic extractant is removed from the reductive stripping operation 1 via stream 4 and recycled back to the primary extraction circuit for use in subsequent extractions as will be made clearer hereinafter. The loaded strip liquor is removed from the reductive stripping operation 1 via stream 5 and subjected to the oxidation operation 6. The resulting oxidized loaded strip liquor is removed via stream 7 and passed into the secondary countercurrent uranium extraction operation 8 into which fresh organic extractant is introduced via stream 9. The uranium-depleted acid raffinate is removed from the secondary uranium extraction operation 8 through stream 10. The uranium-loaded organic extractant is removed through stream 11 and passed to iron removal operation 12 which comprises, in the embodiment shown, two iron removal stages 13A and 13B. Dilute aqueous phosphoric acid is introduced via stream 14 into iron removal stage 13B where it is brought into contact with the uranium-loaded organic extractant passing to it from the first iron removal stage 13A by stream 15. The dilute aqueous phosphoric acid that has been in contact with the uranium-loaded organic extractant in stage 13B is passed as stream 16 to the first stage 13A where it is contacted with the uranium-loaded organic extractant entering stage 13A as stream 11. The iron-containing dilute aqueous phosphoric acid after contact in stage 13A passes from said stage through stream 17 and is sent to stream 7 for entry into secondary extraction operation 8. The iron is eliminated from the system through the uranium-depleted acid raffinate stream 10, which is returned to other stages, e.g., evaporation, of the wet process. The uranium-loaded extractant that has been treated with dilute aqueous phosphoric acid is then passed by stream 18 to the wash stage 19 where it is washed with water entering through line 20 and from which the wash water is directed via stream 21 to stream 7 for entry into secondary extraction operation 8. The washed uranium-loaded organic extractant is passed as stream 22 to the ammonium carbonate stripping stage 23 where it is contacted with ammonium carbonate strip liquor entering via stream 24. The ammonium uranyl tricarbonate (AUT) formed in the ammonium carbonate stripping stage 23 is passed as an aqueous slurry through line 25 to a filter and then to calciner 26 to produce uranium oxide product which is removed via stream 27. The stripped organic extractant is passed from ammonium carbonate stripping stage 23 as stream 28 to sulfuric acid treatment operation 29 wherein it is treated with aqueous dilute sulfuric acid entering the operation as stream 30. The sulfuric acid effluent is removed from the acid treatment operation as stream 31 and the treated organic extractant is removed as stream 32 and passed to organic extractant surge vessel 33, to which make up organic extractant is introduced as stream 35. Organic extractant is recycled from the surge vessel 33 as stream 9 to the secondary countercurrent extraction operation. Optionally, organic extractant from the primary extraction circuit is introduced in surge vessel 33, as stream 34, to supply all or a portion of organic stream 9.

It is to be noted that the strength of the iron-free aqueous dilute phosphoric acid 14 used in the iron removal stages 13A and 13B may be as low as 10% $P_2O_5$ and as high as 40% $P_2O_5$. A 30% $P_2O_5$ acid is preferred, as mentioned before.

Also, the strength of the aqueous sulfuric, hydrochloric, nitric or iron-free phosphoric acid used to treat the stripped organic extractant in accordance with the method of this invention may be as low as 1% and as high as 35%, expressed as weight % $H_2SO_4$, HCl, $HNO_3$ and $H_3PO_4$, respectively. Strengths of between 5 and 30% by weight are preferred.

In the process of this invention any dialkylphosphoric acid and trialkylphosphine oxide can be employed in the organic extractant. Illustrative of such compounds are dihexylphosphoric acid, di-2-ethylhexylphosphoric acids, dioctylphosphoric acid, didecylphosphoric acid, tributylphosphine oxide, trihexylphosphine oxide, trioctylphosphine oxide and tridecylphosphine oxide. The solvent for the organic extractant can be any organic solvent provided that its boiling point is above the temperature used in the process. Illustrative organic solvents include decane, dodecane, kerosene, toluene, p-xylene and ethyl benzene.

As noted hereinabove, the strip liquor used in the reductive stripping contains a complexing agent which can be an aqueous solution of phosphoric acid, $H_3PO_4$, or an aqueous solution of hydrofluoric acid, HF, or an aqueous solution of both $H_3PO_4$ and HF. The concentration of phosphoric acid in the starting strip liquor is preferably between about 40 and 55% $H_3PO_4$ by weight.

The aqueous strip liquor also contains a divalent iron salt. Any divalent iron salt capable of dissolving in the aqueous strip liquor can be used. These include ferrous sulfate $FeSO_4$, ferrous chloride $FeCl_2$, ferrous bromide $FeBr_2$, ferrous nitrate $Fe(NO_3)_2$, and ferrous phosphate $Fe_3(PO_4)_2$.

It is preferred that the concentration of divalent iron in the strip liquor be between about 1 and about 100 grams per liter of solution.

In the reductive stripping step, stripping of uranium values from the uranium containing organic extractant in the presence of the acidic aqueous solution, or strip liquor, can be accomplished by using any type of equipment suitable for liquid-liquid extraction. Commonly known multi-stage "countercurrent" mixer-settler units are especially suitable. The term "countercurrent" denotes that the two phases present during the process, viz, the organic and aqueous phases, move in opposing directions. When using a multi-stage "countercurrent" mixer-settler unit the two phases within each stage are normally subjected to a vigorous mixing in the mixer and then allowed to separate in the settler. After separation, each phase is transferred by mechanical means in opposing directions.

The reductive stripping operation of the process is normally conducted at atmospheric pressure although the stripping could be carried out at pressure other than atmospheric. Changes in the pressure during the stripping operation have little effect on the chemistry and the effectiveness of the overall stripping operation. Minimum pressure selected should be such as to exceed the boiling point requirements of the organic extractant and of the aqueous strip liquor.

Operating conditions for the stripping process are generally selected in such a manner so as to yield a uranium concentration of about 1,000 to about 20,000 p.p.m. expressed as $U_3O_8$ and preferably about 5,000 to about 15,000 p.p.m. $U_3O_8$ by weight. In these concentration ranges, the uranium remains dissolved in the strip liquor when phosphoric acid is the complexing agent and the uranium value after the stripping can be readily recovered in a marketable form by the method of this invention.

In practicing this invention, the uranium content of the extractant prior to stripping is generally between about 150 and about 20,000 parts per million by weight, expressed as $U_3O_8$, preferably between about 300 and about 1000 parts per million by weight. After stripping, the uranium content of the organic extractant is generally between zero and about 100 p.p.m. by weight expressed as $U_3O_8$ and preferably between zero and about 25 p.p.m. expressed as $U_3O_8$, by weight. After contact with the organic extractant, the uranium content of the aqueous stripping solution containing phosphoric acid as the complexing component will be primarily a function of the initial uranium content of the organic extractant and of the volumetric phase ratio of organic to aqueous solutions subjected to liquid-liquid contact.

The pregnant aqueous stripping solution which leaves the reductive stripping step is thereafter subjected to oxidation. Suitable oxidizing agents include sodium chlorate, hydrogen peroxide, air, oxygen, and chlorine. The oxidation can be carried out at ambient temperature or at elevated temperatures. In case a gas is used as the oxidant (air, oxygen or chlorine) the oxidation may be carried out at elevated pressure. It is believed that the oxidation converts the uranium content to the +6 valency state. Thereafter, the uranium values can be recovered by subjecting the resulting solution to extraction with a small stream of organic extractant in the secondary countercurrent uranium extraction step.

As previously mentioned, the uranium-loaded strip liquor is greatly reduced in volume to a fraction of the initial volume of the wet process acid extracted with organic extractant in the primary circuit. The effect of the primary cycle is to concentrate the uranium by a factor of 30 to 100 or more. As a result the strip liquor of the primary circuit can be more economically processed in a relatively small secondary circuit to produce a uranium product of high purity.

The iron present in the uranium-loaded organic stream 11 is virtually all in the $Fe^{+3}$ state. There is virtually no $Fe^{+2}$ iron in this stream. This is mostly because the iron in the uranium-loaded organic stream 11 comes from the oxidized acid stream 7 which subsequently contacts the organic extractant in the secondary countercurrent extraction operation 8. The oxidized acid stream 7 contains $Fe^{+3}$, but virtually no $Fe^{+2}$. Two iron removal stages 13A, 13B are preferred. Three or four, or even five, iron removal stages could be used instead of two, but too many would be impractical. The aqueous-to-organic volumetric ratio (A/O) in the iron removal operation 13A, 13B, that is, the volumetric flow ratio of stream 14 to stream 11 can be as little as 1/500 and can go as high as 1/10. A one minute retention time in each mixer is adequate. Mixing retention times should not be less than 10 seconds or more than 5 minutes.

The iron removed in the iron removal stages remains in the $Fe^{+3}$ state in the phosphoric acid stream 17 leaving the two stages 13A and 13B. This stream is then blended with the dilute phosphoric acid (less than about 25% $P_2O_5$) stream 21 leaving the water washing operation 19 of the organic extractant and with the oxidized phosphoric acid stream 7 which is fed to the secondary C.C. uranium extraction 8. The bulk of the iron is conveniently eliminated from the system through stream 10, the uranium-free acid raffinate; and the raffinate is returned to one or more stages of the wet process train for further purification and/or recovery.

The organic-to-aqueous volumetric flow ratio (O/A), i.e., the volumetric flow ratio of stream 22 to stream 24, for the carbonate stripping operation 23 is typically 1/1. It can extend between about 5/1 and about 1/1. A one-minute mixing retention or contact time in the carbonate stripping operation 23 has proven to be adequate for depleting the organic extractant of its uranium values. The carbonate stripping operation 23 is typically carried out at a temperature of about 100° F.

Likewise, more than one stage can be used for the dilute aqueous acid treatment 29 of the stripped organic extractant stream 28, but one is adequate. The organic-to-aqueous volumetric ratio (O/A), i.e., the volumetric flow ratio of stripped organic extractant stream 28 to the aqueous dilute acid stream 30, in the acid treatment 29 is typically 4/1. It can be any value between about 10/1 and about 2/1. X-ray diffraction analyses of the precipitated solids that form during extraction operation 8 when the acid treatment is not used show that these solids seem to have the composition $Fe_3NH_4H_8(PO_4)_6.6H_2O$, or $Al_3NaH_8(PO_4)_6.6H_2O$, or a combination of these.

The temperature at which these above-described operations are carried out is typically between 75° and 110° F, although it could range from about 60° to about 150° F. Temperatures substantially above about 150° F might affect the volatility of the organic extractant and are not, therefore, considered to be beneficial.

Typical volumetric flow ratios for the organic extractant to wet process acid fall in the range of 1/5 to 2/1. Other typical volumetric flow ratios are given below:

| | |
|---|---|
| Organic extractant stream 2 to strip liquor stream 3 | 1/30 to 1/100 |
| Organic extractant recycle stream 9 to oxidized acid-loaded strip liquor 7 | 1/2 to 2/1 |
| Uranium-loaded organic extractant stream 18 to wash water stream 20 | 1/1 to 100/1 |

The apparatus described in U.S. Pat. No. 3,737,513 can be employed in the primary and secondary circuits as well as the iron removal and acid treatment operations described herein. However, any suitable apparatus can be used to achieve the desired result.

The following table provides the proportions in each stream as identified therein of the component in the column headed "Example" also identified in the table for a specific embodiment or example. Also listed in the table in the column headed "Range" are typical ranges of said proportions. The following abbreviations as used in the table are defined below:

| Abbreviation | Definition |
|---|---|
| aqu. | aqueous |
| org. | organic |
| sol. | solids |
| AUT | ammonium uranyl tricarbonate |
| TOPO | trioctylphosphine oxide |
| D2EHPA | di-2-ethylhexyl phosphoric acid |
| p.p.m. | parts per million parts |
| gpl | grams per liter |
| % | weight percent |
| mg/l | milligrams per liter |
| C.C. | countercurrent |

The column headed "Stream No." identifies each stream by reference number given in the attached drawing.

TABLE

| Stream | Stream No. | Phase | Component | Example | Typical Range |
|---|---|---|---|---|---|
| feed to secondary extraction | 7 | aqu. | $U_3O_8$ | 6,000 ppm | 1,000–10,000 ppm |
| " | 7 | aqu. | Fe | 28 gpl | 10–50 gpl |
| " | 7 | aqu. | $P_2O_5$ | 30% | 25–35% |
| organic entering secondary extraction | 9 | org. | $U_3O_8$ | 20 ppm | 0–30 ppm |
| " | 9 | org. | Fe | nil | 0–5 mg/l |
| " | 9 | org. | TOPO | 0.075M TOPO | 0.05–0.1M TOPO |
| " | 9 | org. | D2EHPA | 0.3M D2EHPA | 0.25–0.6M D2EHPA |
| uranium-loaded organic extract | 11 | org. | $U_3O_8$ | 10,000 ppm | 5,000–20,000 mg/l |
| " | 11 | org. | Fe | 400 mg/l | 200–1,000 mg/l |
| " | 11 | org. | TOPO-D2EHPA | same as Stream No. 9 | |
| uranium-free acid raffinate | 10 | aqu. | $U_3O_8$ | 100 | 10–200 ppm |
| " | 10 | aqu. | Fe | 28 gpl | 10–40 gpl |
| iron-free phosphoric acid | 14 | aqu. | $P_2O_5$ | 30% | 10–40% |

TABLE-continued

| Stream | Stream No. | Phase | Component | Example | Typical Range |
|---|---|---|---|---|---|
| " | 14 | aqu. | Fe | <0.05% | <0.3% |
| treated uranium-loaded extract | 18 | org. | $U_3O_8$ | 10,000 ppm | 5,000–20,000 ppm |
| " | 18 | org. | Fe | 10 mg/l | <30 mg/l |
| " | 18 | org. | $H_3PO_4$ | 0.2% | <0.4% |
| washed uranium-loaded extract | 22 | org. | $H_3PO_4$ | nil | nil |
| " | 22 | org. | $U_3O_8$ | 10,000 ppm | 5,000–20,000 ppm |
| " | 22 | org. | Fe | 10 mg/l | <30 mg/l |
| carbonate strip liquor | 24 | aqu. | $(NH_4)_2CO_3$ | 0.5M | 0.3–0.5M |
| " | 24 | aqu. | pH | 9 | 8–10 |
| AUT liquor | 25 | aqu. | $U_3O_8$ | 17 gpl | 12–20 gpl |
| " | 25 | aqu. | Fe | 0.02 gpl | 0–0.10 gpl |
| uranium oxide product | 27 | sol. | $U_3O_8$ | 99.9% | 90–100% |
| " | 27 | sol. | Fe | 0.006% | <0.1% |
| stripped organic | 28 | org. | $U_3O_8$ | 20 ppm | 0–50 ppm |
| " | 28 | org. | TOPO-D2EHPA | same as Stream No. 9 | |
| " | 28 | org. | $NH_3$ | 5 gpl | 1–20 gpl |
| aqueous sulfuric acid | 30 | aqu. | $H_2SO_4$ | 20% | 5–30% |
| treated recycle organic extractant | 32 | org. | TOPO-D2EHPA | same as Stream No. 9 | |
| treated recycle organic | 32 | org. | $NH_3$ | <0.01 gpl | <1.0 gpl |
| acidic effluent | 31 | aqu. | $H_2SO_4$ | 20% | 10–30% |
| " | 31 | aqu. | $NH_3$ | 50 gpl | 10–100 gpl |

The expression and typical values and ranges employed in the specifications are used as terms of description and not of limitation. There is no intention, in the use of such expressions, typical values and typical ranges of excluding any equivalents of the features shown and described or portions thereof, and it should be recognized that various modifications are possible within the scope of the claimed invention. The apparatuses described for practicing the invention are not a part of it. Any apparatuses can be used that will achieve the desired results.

What is claimed is:

1. Process for removing iron from an extractant containing uranium values and comprising a dialkylphosphoric acid and a trialkylphosphine oxide dissolved in a water-immiscible organic solvent and having dissolved therein trivalent iron which comprises contacting said extractant with dilute aqueous phosphoric acid containing less than 0.3% by weight of iron at least once to transfer said trivalent iron to said dilute aqueous phosphoric acid and disengaging the dilute aqueous phosphoric acid containing the transferred trivalent iron from said extractant.

2. Process as claimed in claim 1 wherein said dilute aqueous phosphoric acid prior to contacting said extractant has a concentration of about 10 to about 40 weight % $P_2O_5$.

3. Process as claimed in claim 2 wherein said dilute aqueous phosphoric acid prior to contacting said extractant contains less than 0.05% by weight of iron.

4. Process as claimed in claim 2 wherein said dilute aqueous phosphoric acid prior to contacting said extractant has a concentration of about 30 weight % $P_2O_5$.

5. Process as claimed in claim 2 wherein said extractant is stripped twice with said dilute aqueous phosphoric acid.

6. Process as claimed in claim 2 wherein the volumetric ratio of said dilute aqueous phosphoric acid to said extractant is about 1:500 to about 1:10.

7. Process as claimed in claim 2 wherein said organic extraction comprises di(2-ethylhexyl) phosphoric acid and trioctylphosphine oxide dissolved in a water-immiscible organic solvent.

8. A process for the recovery of uranium from a wet process phosphoric acid solution derived from the acidulation of uraniferous phosphate ores which comprises (a) contacting said solution with an organic extractant comprising a dialkylphosphoric acid and a trialkylphosphine oxide dissolved in a water-immiscible organic solvent, (b) reductively stripping the extractant of uranium with a strip solution in which ferrous iron is used to reduce uranyl ions in the extractant to tetravalent uranium ions in the strip solution, (c) disengaging the strip solution from the organic phase, (d) contacting said strip solution with an oxidizer which converts tetravalent uranium to hexavalent form, (e) contacting the resultant oxidizer-treated solution with an organic extractant having the composition described above, (f) contacting the resulting extractant with dilute aqueous phosphoric acid containing about 10 to about 40 weight % $P_2O_5$ and less than 0.3 weight % of iron at least once to transfer said trivalent iron to said dilute aqueous phosphoric acid and disengaging the dilute aqueous phosphoric acid containing the transferred trivalent iron from said extractant, and (g) stripping the uranium from the organic phase with an aqueous solution of ammonium carbonate to produce a product comprising ammonium uranyl tricarbonate.

9. Process as claimed in claim 8 wherein there is included the step of adding said disengaged dilute aqueous phosphoric acid resulting from step (f) to said oxidizer-treated solution.

10. Process as claimed in claim 8 wherein there is included the step of contacting the stripped organic extractant resulting from step (g) with a dilute aqueous acid selected from the group consisting of sulfuric acid, hydrochloric acid, nitric acid and phosphoric acid, said phosphoric acid containing less than 0.3 weight % of iron, said dilute aqueous acid having a concentration of 1 to 35 weight %, and recycling the thus treated organic extractant to step (e).

11. Process as claimed in claim 10 wherein said thus treated organic extractant is recycled to step (a).

* * * * *